US006279684B1

(12) United States Patent
Lewis

(10) Patent No.: US 6,279,684 B1
(45) Date of Patent: Aug. 28, 2001

(54) NEWSPAPER DISPENSING APPARATUS AND METHOD

(75) Inventor: Jerry Lewis, Coconut Creek, FL (US)

(73) Assignee: The Sun-Sentinel Company, Fort Lauderdale, FL (US)

( * ) Notice: Subject to any disclaimer, the term of this patent is extended or adjusted under 35 U.S.C. 154(b) by 0 days.

(21) Appl. No.: 09/544,079

(22) Filed: Apr. 6, 2000

(51) Int. Cl.[7] ..... A47F 1/00; G07F 7/04

(52) U.S. Cl. ..... 186/36; 194/350

(58) Field of Search ..... 194/350; 186/36

(56) References Cited

U.S. PATENT DOCUMENTS

| | | | | |
|---|---|---|---|---|
| 4,189,031 | * | 2/1980 | Vayda, Jr. | 186/36 |
| 4,654,513 | | 3/1987 | Hennessy | 235/381 |
| 4,802,606 | | 2/1989 | Daniels | 221/39 |
| 4,875,598 | * | 10/1989 | Dahl | 221/229 |
| 5,115,941 | * | 5/1992 | Gueretta | 221/229 |
| 5,381,880 | * | 1/1995 | Pearson | 194/217 |
| 5,918,764 | * | 7/1999 | Bustos et al. | 186/55 |
| 6,003,725 | | 12/1999 | Blankeman et al. | 221/195 |

OTHER PUBLICATIONS

"New TK–97 Service Station Rack Offered by Sho–Rack®," Sho–Rack Horizon, Jan. 2000, p. 1, author unknown.

* cited by examiner

*Primary Examiner*—Robert P. Olszewski
*Assistant Examiner*—Bryan Jaketic
(74) *Attorney, Agent, or Firm*—Sonnenschein, Nath & Rosenthal; Jordan A. Sigale; Brian R. McGinley

(57) ABSTRACT

A newspaper dispensing apparatus includes a housing having a cavity for storing newspapers. A door is pivotally attached to the housing via a pair of hinges. A locking subassembly releasably engages the door in a closed position. The disclosed apparatus is fabricated entirely from plastic to eliminate concern of corrosion and the risk of sparks. In an alternative embodiment, the apparatus is fabricated from high strength steel, but selected portions of the apparatus including the locking subassembly, hinges and portions of the door, are covered with non-corrosive, spark proof materials to prevent metal-to-metal contact. Thus, the apparatus can be positioned immediately adjacent gasoline pumps at a service station without the risk of creating sparks, fire or an explosion. A method is also disclosed for providing a paid newspaper from a location substantially adjacent to a gasoline dispensing apparatus and further for the purchase of gasoline and a newspaper in one transaction via a payment mechanism attached to the apparatus.

18 Claims, 3 Drawing Sheets

NEWSPAPER DISPENSING APPARATUS AND METHOD

BACKGROUND OF THE INVENTION

1. Field of the Invention

The present invention relates generally to dispensing apparatus and methods, and more particularly to a spark proof, automated newspaper dispensing apparatus which may be operably positioning in the vicinity of volatile, flammable or combustible materials.

2. Background Art

The distribution of newspapers to consumers occurs in many ways, including by home delivery, via sales at retail outlets such as supermarkets, convenience stores, and service stations, and by newspaper dispensing machines. Conventional newspaper dispensing machines are well known. Such dispensers are generally fabricated from metal and include a housing with a cavity for storing the newspapers, a door providing access to the cavity, and a locking mechanism for selectively securing the door in a closed position. Typically, a user inserts coins or paper money into the dispenser, releasing the locking mechanism to allow the user to open the door and remove a newspaper.

Prior art dispensing machines are often positioned in remote unsupervised locations, such as adjacent retail stores, in parking lots, or on street comers. As such, the dispensers necessarily have been made from strong, durable materials to deter theft and vandalism. In particular, the locking mechanisms and other important components have been fabricated from high strength steel.

During operation, prior art newspaper dispensers are prone to producing sparks caused by metal-to-metal contact, for example when the door is slammed shut by a consumer after a purchase. As a result, it is not desirable to use such dispensers in proximity to volatile, flammable, or combustible materials, such as at service stations near gasoline pumps. Moreover, local, state and/or federal laws and regulations frequently prohibit the use of these dispensers near such materials. While plastic newspaper dispensers would solve these safety concerns, plastic dispensers have not been used for paid newspaper distribution because of their susceptibility to theft and vandalism.

Providing consumer convenience is a major factor motivating the use of newspaper dispensers. Indeed, consumer convenience often dictates purchasing decisions. An example is the implementation of automated payment systems in connection with retail gasoline pumps whereby the consumer may use credit cards, debit cards or the like to purchase gas "from the pump." An increasing number of consumers are choosing to "pay at the pump" without physically entering the place of business. As a result, retailers are experiencing a reduction in impulse purchases of merchandise, such as newspapers, periodicals, snack foods and the like, which were previously the result of consumers entering the store to purchase gasoline. Consumers have found it inconvenient to enter the retail place of business to purchase a newspaper when "paying at the pump" for gasoline. As a result, newspapers sales have suffered.

Heretofore, it has been impossible to recapture the newspaper sales lost to "pay-at-the-pump" consumers by placing the dispensers in the vicinity of gasoline pumps because of the overriding safety concerns discussed above. A need exists for a safe, convenient newspaper dispensing apparatus which may be positioned adjacent gasoline pumps and other volatile, flammable or combustible materials.

SUMMARY OF THE INVENTION

The above problems are solved, and a number of technical advances are achieved in the art, by implementation of a novel newspaper dispensing apparatus and method. The apparatus includes a housing having a cavity for storing newspapers. The cavity defines an opening in a front surface of the housing. A door is pivotally attached to the housing via a pair of hinges. In its closed position the door covers the opening. A locking subassembly is provided to releasably engage the door in the closed position. The door is released or unlocked upon verification of payment from a user, providing the user access to a newspaper.

In one embodiment, the apparatus is constructed substantially from non-corrosive, spark proof materials such as plastic, and does not contain any metal or spark inducing parts which contact similar spark inducing parts. The plastic apparatus may be safely positioned adjacent volatile materials, for example between gasoline pumps at a service station, without the risk of creating sparks or otherwise igniting. Theft and vandalism are not prohibitive concerns associated with using the plastic apparatus because in operation the apparatus is positioned within the view of a service station attendant.

In another embodiment, the apparatus is fabricated from conventional high strength steel. However, the locking subassembly, as well as portions of the door, cavity, and other "contact areas" are covered with non-corrosive, spark proof materials such as cork, rubber, plastic or the like. In operation, due to the provision of the protective coatings, the apparatus may also be positioned immediately adjacent gasoline pumps or other volatile materials without the risk of creating sparks or otherwise igniting. This embodiment provides the dual benefits high strength and safety.

The present invention also discloses a method for providing a paid newspaper from a location substantially adjacent to a gasoline dispensing apparatus whereby a newspaper dispensing apparatus is constructed to withstand deployment in the vicinity of volatile, flammable or combustible materials, and the apparatus is placed in a supervised location substantially adjacent to the gasoline dispensing apparatus.

The present invention also discloses a method for "paying-at-the-pump" whereby a user, in one transaction, can control the purchase and dispensing of gasoline and a newspaper from an apparatus via a control device thereof.

Other advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various features thereof.

DESCRIPTION OF THE PREFERRED EMBODIMENTS

Figure 1:
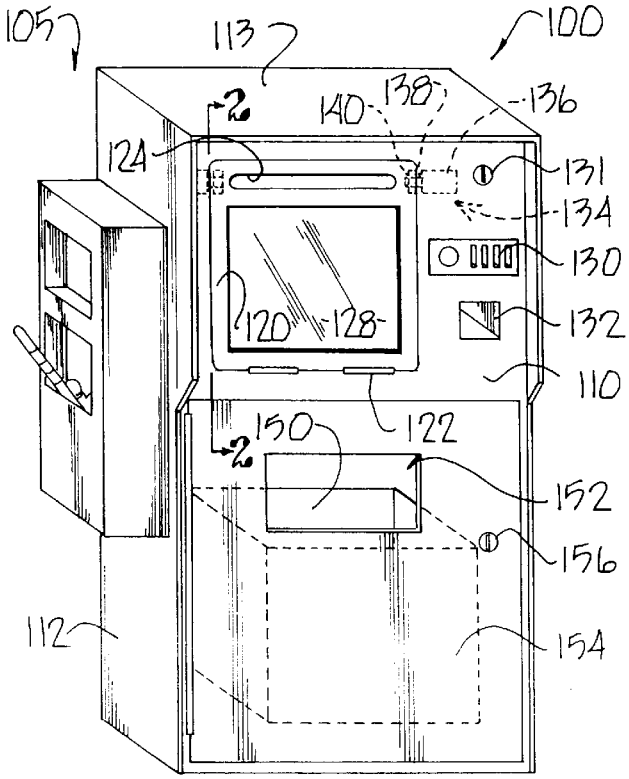
FIG. 1 is a perspective view of a newspaper dispensing apparatus exemplifying the present invention, and showing a locking subassembly and a receptacle thereof each in hidden lines.

While the present invention may be embodied in many different forms, there is shown in the drawings and discussed herein a few specific embodiments with the understanding that the present disclosure is to be considered only as an exemplification of the principles of the invention and is not intended to limit the invention to the embodiments illustrated.

Figure 2:
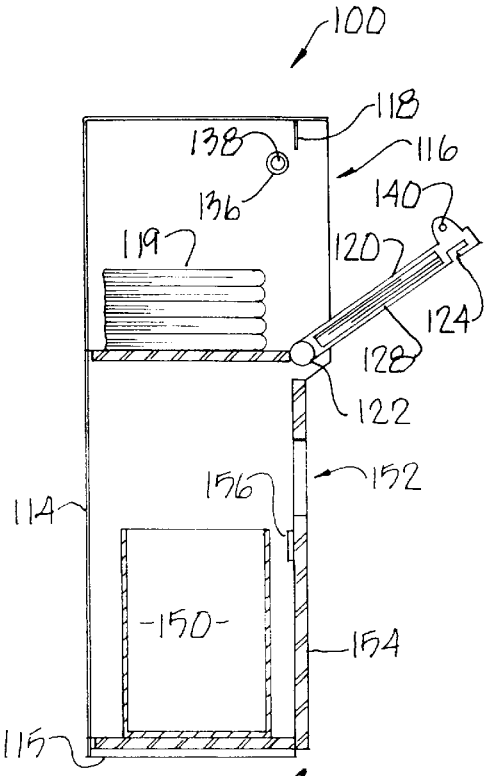
FIG. 2 is a sectional view of the apparatus of FIG. 1 taken along line 2—2.

Referring to FIG. 1 and FIG. 2 in greater detail, the reference number 100 refers to a newspaper dispensing apparatus 100 embodying the present invention. The apparatus 100 is fabricated substantially of non-corrosive, spark-proof materials such as plastic, fiberglass, phenalic or the like to eliminate the possibility of sparks or any other ignition which may be caused by contact between cooperating parts of the apparatus 100 or by accidental collision between an automobile and apparatus 100. The apparatus 100 does not contain any metal components or spark inducing components which contact similar components.

Referring to FIG. 1, the apparatus 100 includes a housing 105 having a front 110, a pair of opposed sides 112, a top 113, a rear 114, and a bottom 115. Referring to FIG. 2, a cavity 116 which defines a first opening 118 in the front 110 is formed within the housing 105. Newspapers 119 are stored within the cavity 116. A door 120 is pivotally secured to the front 110 by a pair of hinges 122. In its closed position as shown in FIG. 1, the door 120 covers the first opening. A handle 124 is formed an upper portion of the door 120. In operation, the handle 124 may be grasped by a user and pulled to pivot the door 120 about the hinges 122, providing access to the cavity to remove the newspapers 119. The door 120 may include a transparent panel or window 128 formed therein, allowing a user to look into the cavity 116.

As discussed more below, the apparatus 100 also includes a payment mechanism 130, such as a coin or bill depository, or an electronic ATM, credit or debit card scanner for receiving and processing electronic payment from users. Deposited coins and bills can be accessed and removed from the apparatus 100 via a key at lockbox 131. A change return mechanism 132 is also provided for dispensing change or for providing a receipt for a transaction.

Referring to FIG. 1, a locking subassembly 134 is provided for releasably engaging the door 120 in its closed position. For example, referring to FIG. 1 and FIG. 2, the locking subassembly 134 may comprise a pair of solenoids 136 having respective latches 138 slidably attached thereto, and a pair of coupling brackets 140 sized for receiving the latches 138. The solenoids 136 are fixedly attached to an inner surface of the front 110 near the top 114. The brackets 140 are fixedly attached to an inner surface of the door 120 in alignment to receive the latch 138 when the door 120 is in its closed position. Other locking subassemblies well-known for use with newspaper dispenser may also be used in conjunction with apparatus 100, requiring perhaps, in some instances, materials modifications to comply with safety issues.

In operation, the payment mechanism 130 determines if the payment from the user is adequate. Upon verification, the payment mechanism 130 transmits a signal to energize the solenoid 136 whereupon the latch 138 retracts into the solenoid 134, removing the latch 136 from the bracket 138. Upon release of the latch 136, the user may pull the door 120 open via the handle 124, whereby the door 120 rotates about the hinges 122 and against a biasing force applied by springs (not shown).

The apparatus 100 also includes a receptacle 150 accessible via a second opening 152 in the front 110. The receptacle 150 is provided for the deposit and collection of trash, recyclables, cigarettes, etc. A hinged access door 154 and a lock 156 are also provided in connection with the receptacle 150.

Figure 4:
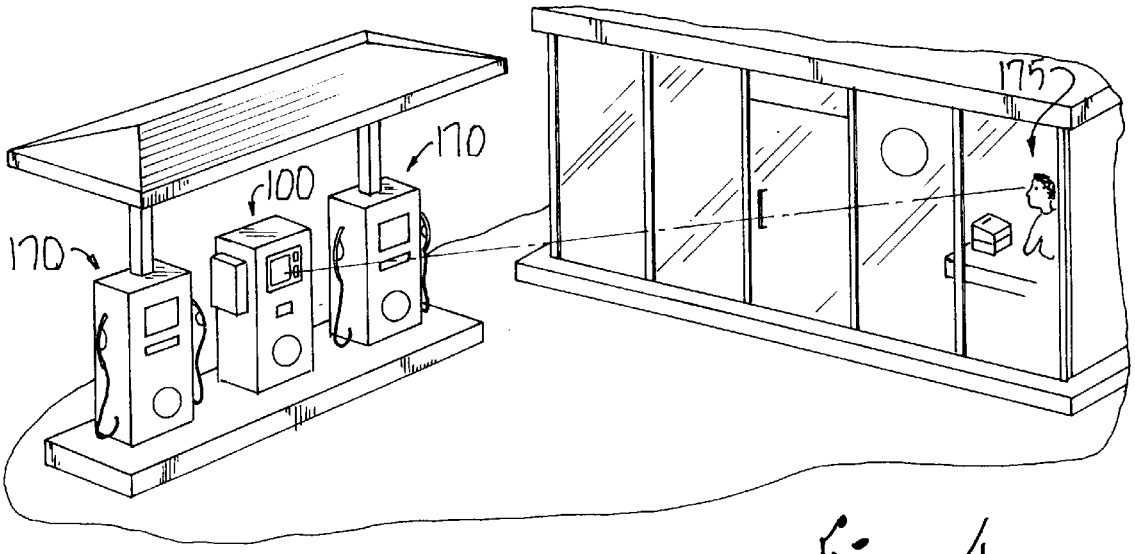
FIG. 4 is a perspective view of the apparatus of FIG. 1 showing the apparatus in operation adjacent gasoline pumps at a service station.

Referring to FIG. 4, in operation the apparatus 100 may be positioned adjacent gasoline pumps 170 at a service station. The fabrication of the apparatus substantially from spark proof materials eliminates the risk of sparks or other ignition which may otherwise result, for example, when a user releases the door 120, causing the door to impact the front 110 and/or the locking subassembly 134. It should also be noted that the apparatus 100 is positioned between the pumps 170 such that it is readily within the view of a service station attendant 175. Thus, the attendant 175 can monitor the apparatus 100 to greatly reduce the risk of theft or vandalism to the apparatus 100 which may be increased by the use of many non-corrosive materials, such as plastic.

Figure 3:
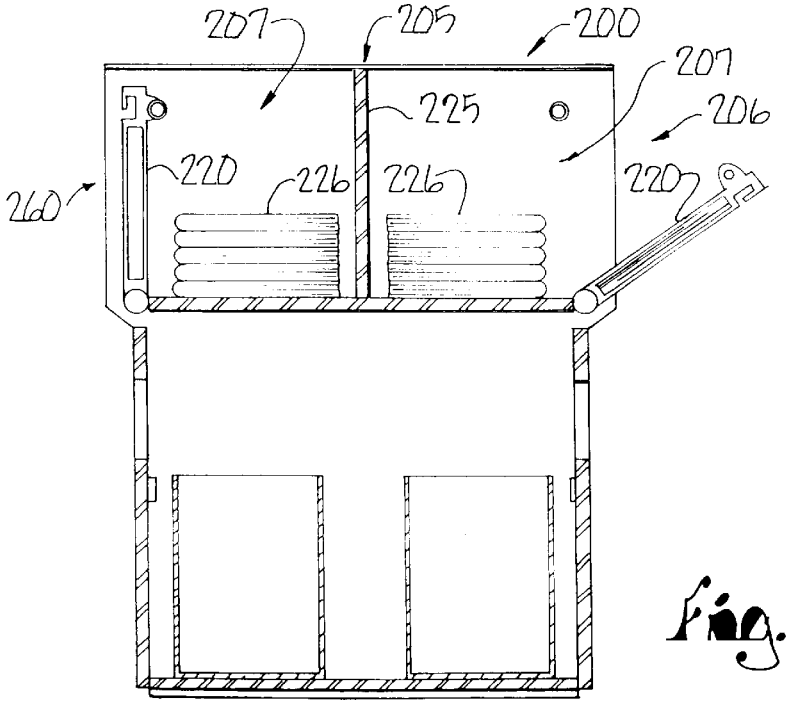
FIG. 3 is a side view of a first modified embodiment of the present invention showing a newspaper dispensing apparatus having a pair of newspaper dispensers in a "back-to-back" configuration.

Referring to FIG. 3, the reference number 200 refers to another embodiment of the present invention. The apparatus 200 differs from the apparatus 100 in the provision of a housing 205 comprising a pair of newspaper dispensers 206. Each dispenser 206 includes a cavity 207 for storing newspapers and a respective door 220 pivotally attached to the housing 205 covering the cavities 207. The cavities 207 are adjacent one another in "backto-back" alignment. A wall or divider 225 is provided to isolate the cavities 207 from one another. The doors 220 face outward away from one another, providing access to newspapers 226 within the apparatus 200 from either door 220. In operation the apparatus 200 may be conveniently positioned adjacent one or more gasoline pumps such that the newspapers 226 can be dispensed from either side of the gasoline pumps. In other regards, the apparatus 200 is substantially similar to the apparatus 100. It is also foreseen that the dispensers 206 may be operably positioned in a side by side configuration instead of a back to back configuration.

Figure 5:
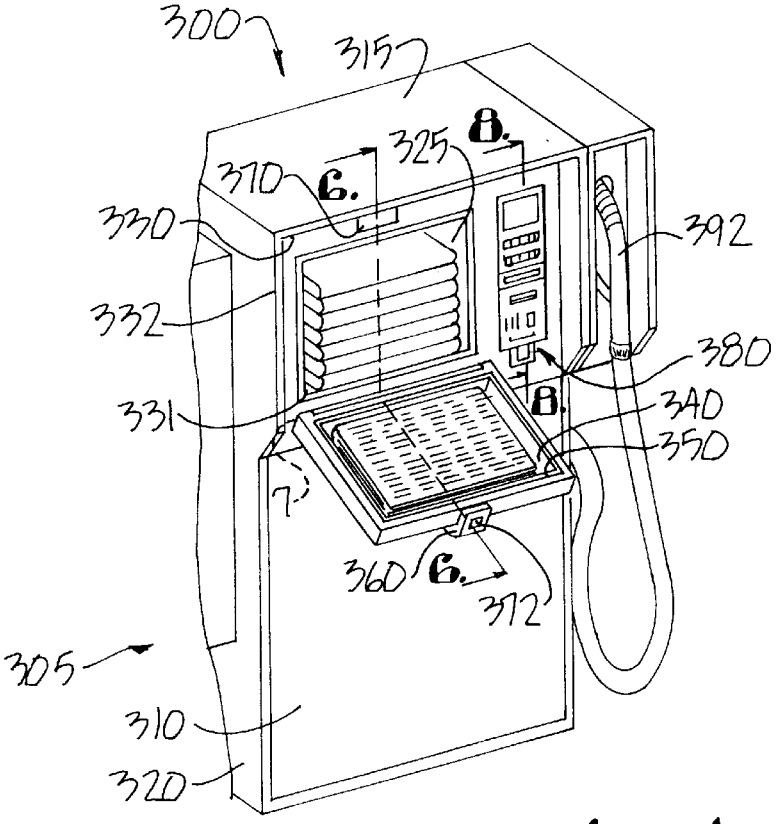
FIG. 5 is a perspective view of a newspaper dispensing apparatus comprising a second modified embodiment of the present invention, showing the apparatus attached to a conventional gasoline pump.

Referring to FIG. 5, the reference number 300 refers to another newspaper dispensing apparatus exemplifying the present invention. The apparatus 300 differs from the apparatus 100 in that, as discussed more below, the apparatus 300 may be fabricated from a metal such as high strength steel.

The apparatus 300 includes a housing 305 having a front 310, a top 315, a pair of sides 320 and a bottom (not shown). A cavity 325 for storing newspapers and the like is formed within the housing 305. The cavity 325 includes upper and lower edges 330,331, and a pair of sides 332. Outer surfaces of the edges 330,331 and the sides 332 are covered with cork, rubber, plastic coatings, or similar non-corrosive, spark proof materials.

Figure 6:
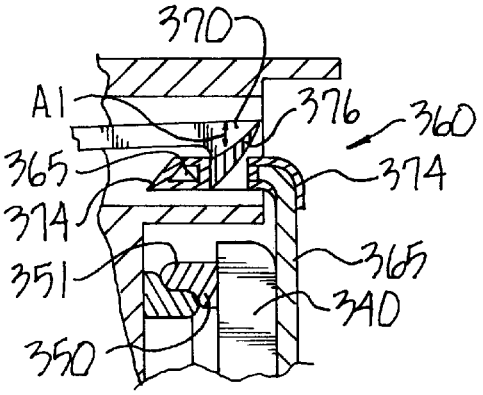
FIG. 6 is an enlarged, fragmentary sectional view of the apparatus of FIG. 5, taken along line 6—6, and showing a locking subassembly thereof.
Figure 7:
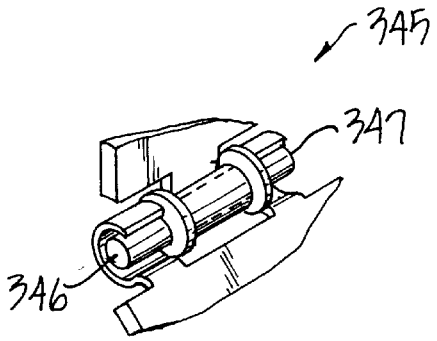
FIG. 7 is an enlarged, fragmentary perspective view of the apparatus of FIG. 5, and showing a hinge thereof.

Referring to FIGS. 5–7, a door 340 is pivotally attached to the front 310 via a pair of hinges 345. As indicated in FIG. 7, outer surfaces 347 of a shaft 346 of the hinges 345 may be covered with cork, rubber, plastic coating, or similar non-corrosive, spark proof materials. Referring to FIG. 5 and FIG. 6, the door 340 includes an upper lip 350 having upper and lower surfaces. As shown at coating 351 in FIG. 6, an outer surface of the upper lip 350 is covered with cork, rubber, plastic coatings, or similar non-corrosive, spark proof materials.

Referring to FIG. 5 and FIG. 6, a locking subassembly 360 is used in connection with the apparatus 300 to releasably engage the door 340 in its closed position. FIG. 6 shows the door 340 in its closed or locked configuration. The locking subassembly 360 includes a hook 365 attached to an outer surface of the door 340, and a latch 370 fixedly attached to a lower surface of the housing top 315. The hook 365 includes an opening 372 for receiving the latch 370 when the door 340 is in its closed position. As indicated by arrow A1 in FIG. 6, the latch 370 is designed to travel upwards and downwards to selectively release or engage the hook 365, thereby locking or unlocking the door.

Outer surfaces of the hook 365 are coated with cork, rubber, plastic or similar non-corrosive, spark proof materials as indicated at coating 374 in FIG. 6. Similarly, outer surfaces of the latch 370 are covered with cork, rubber, plastic or similar non-corrosive, spark proof materials as indicated at coating 376 in FIG. 6.

In operation, the provision of the coatings 351, 374, 376 prevents metal-to-metal contact which would otherwise exist. For example, when the door 340 is in its closed position the latch 370 engages the hook 365, and the upper lip 350 engages and the upper edge 331 of the door 320. The provision of the coatings 351, 374, 376 in these contact areas eliminates the creation of sparks caused by metal-to-metal contact. Similarly, the provision of the coating 351 at the hinges 345, will further reduce the possible creation of sparks caused by metal-to-metal contact or friction at the hinges 345.

Figure 8:
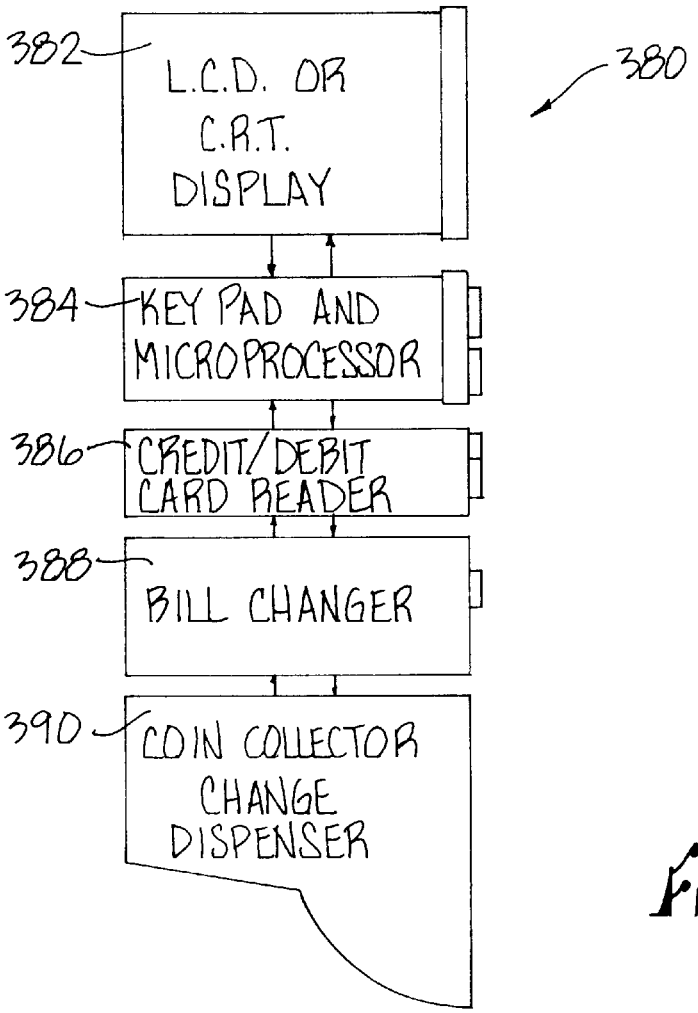
FIG. 8 is an enlarged, sectional view of the apparatus of FIG. 5 taken along line 8—8, and showing a payment mechanism thereof

As shown in FIG. 5 and FIG. 8, a control device or payment mechanism 380 is provided in connection with the apparatus 300. The payment mechanism 380 includes a L.C.D. or C.R.T. display 382, a keypad and microprocessor 384, a credit/debit card reader 386, a bill changer 388 and coin collector/change dispenser 390.

The payment mechanism 380 allows users to selectively control the purchase and dispensing of gasoline from a gasoline dispensing apparatus or pump 392, and newspapers from the apparatus 300 in one transaction by "paying at the pump." For example, by well known methods the user can select transaction payment type, such as payment by ATM, debit or credit card by indicating an electronic, such as credit card, transaction at the keypad 384 and then swiping or entering his or her credit card number at the reader 386. Alternatively, the user can select cash transaction and input cash and coins into the changer 388 and the dispenser 390.

Upon verification of proper payment, the microprocessor 384 will prompt the user via the display 382 with a series of questions relating to the transaction. For example, the user will be asked whether he or she wants to purchase gasoline. The user will input "yes" or "no" via controls at the keypad 384. If the user inputs "yes," the microprocessor 384 will transmit a control signal to the gasoline dispensing apparatus to dispense gas. The microprocessor 384 will then prompt the user via the display 382 to indicate whether he or she wants to purchase a newspaper. The user can again input "yes" or "no" at keypad 384. If the user inputs "yes," the microprocessor 384 sends a control signal to the locking subassembly 360 to disengage the latch 370, allowing the user to open the door 340 and remove a newspaper. Alternatively, the microprocessor may send a control signal to a pneumatic device or piston (not shown) to automatically open the door 340 if the user inputs "yes" at the microprocessor 384. In any event, the entire transaction (i.e., the purchase of gasoline and newspapers) may be controlled by the user at the payment mechanism 380, and further may be billed as one transaction should the user pay by credit card or the like. Of course, the user can alternatively select a cash transaction at the keypad 384, and similarly use the changer 388 to pay for gasoline and a newspaper in one transaction.

It should be recognized that there are many options regarding how and where to place the various interfaces and the variations should not limit the spirit or intent of the present invention. It should be further recognized that any of the known technologies utilized for automated dispensing of newspapers, periodicals, beverages, foodstuffs or similar may be incorporated within the present invention.

The foregoing description of the embodiments of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and modifications as are suited to the particular use contemplated. It is intended that the scope of the invention not be limited by the specification, but be defined by the claims set forth below.

What is claimed is:

1. A newspaper dispensing apparatus, which may be operably positioned in the vicinity of volatile, flammable, or combustible materials, said apparatus comprising:

(a) a housing having a cavity for storing newspapers; said cavity defining an opening in a front surface of the housing, the housing being generally fabricated substantially from non-corrosive, spark proof materials, said housing being located in a supervised location;

(b) a door pivotally attached to said housing and covering said opening; said door pivotable from a closed position generally covering said opening to an open position providing access to said cavity through said opening; and (c) a locking subassembly for releasably engaging said door in the closed position, the locking subassembly being generally fabricated substantially from non-corrosive, spark proof materials.

2. The invention according to claim 1 wherein said apparatus further includes a payment acceptance subassembly operably associated with said locking subassembly such that said door is released upon insertion of a adequate payment in the payment acceptance subassembly.

3. The invention according to claim 2 wherein said payment acceptance subassembly accepts payment selected from the group consisting of ATM cards, coinage, credit cards, debit cards, and paper currency.

4. The invention according to claim 1 wherein said newspaper dispensing apparatus is located substantially adjacent to a gasoline dispensing apparatus, said gasoline dispensing apparatus having an associated control device including a display, a keypad, a microprocessor and payment acceptance mechanisms, said control device being operably associated with said locking subassembly such that said door is released upon receipt of a adequate payment by said control device associated with said gasoline dispensing apparatus.

5. The invention according to claim 1 wherein said apparatus further includes a second opening in said housing operably associated with a trash receptacle.

6. The invention according to claim 1 wherein said apparatus further includes a second housing operably attached in back to back alignment with said housing.

7. The invention according to claim 1 wherein said apparatus further includes a second housing operably attached in side to side alignment with said housing.

8. A newspaper dispensing apparatus which may be operably positioned in the vicinity of volatile, flammable, or combustible materials, said apparatus comprising:

(a) a housing having a cavity for storing newspapers; said cavity defining an opening in a front surface of the housing; said opening presenting a plurality of outer contact surfaces;

(b) a door pivotally attached to said housing and covering said opening; said door pivotable from a closed position generally covering said opening to an open position providing access to said cavity through said opening; said door presenting a plurality of contact surfaces in alignment with and cooperating with said opening contact surfaces;

(c) a locking subassembly for releasably engaging said door in the closed position; said locking assembly including a hook having an outer surface and a latch having an outer surface; said hook outer surface engaging said latch outer surface when said door in is said closed position; and (d) said opening contact surfaces, said door contact surfaces, said hook outer surface and said latch outer surface covered with a non-corrosive, spark proof material.

9. The invention according to claim 8 wherein said apparatus further includes a payment acceptance subassembly operably associated with said locking subassembly such that said door is released upon insertion of a adequate payment in the payment acceptance subassembly.

10. The invention according to claim 9 wherein said payment acceptance subassembly accepts payment selected from the group consisting of ATM cards, coinage, credit cards, debit cards, and paper currency.

11. The invention according to claim 8 wherein said newspaper dispensing apparatus is located substantially adjacent to a gasoline dispensing apparatus, said gasoline dispensing apparatus having an associated control device including a display, a keypad, a microprocessor and payment acceptance mechanisms, said control device being operably associated with said locking subassembly such that said door is released upon receipt of a adequate payment by said control device associated with said gasoline dispensing apparatus.

12. The invention according to claim 8 wherein said apparatus further includes a second opening in said housing operably associated with a trash receptacle.

13. The invention according to claim 8 wherein said apparatus further includes a second housing operably attached in back to back alignment with said housing.

14. A method for providing a paid newspaper from a location substantially adjacent to a gasoline dispensing apparatus, said method comprising:

(a) constructing a newspaper dispensing apparatus to withstand deployment in the vicinity of volatile, flammable, or combustible materials, said apparatus having a housing being generally fabricated substantially from non-corrosive, spark proof materials;

(b) placing the newspaper dispensing apparatus in a supervised location substantially adjacent to the gasoline dispensing apparatus;

(c) storing newspapers in a selectively locked cavity in the newspaper dispensing apparatus;

(d) receiving a adequate payment from a user; and (e) unlocking said cavity in response to receipt of the adequate payment from the user.

15. The invention according to claim 14 wherein constructing the newspaper dispensing apparatus includes using non-corrosive, spark proof materials.

16. The invention according to claim 14 wherein constructing the newspaper dispensing apparatus includes providing non-corrosive, spark proof contact surfaces.

17. The invention according to claim 14 wherein the gasoline dispensing apparatus has a payment acceptance subsystem, receiving the adequate payment from a user includes:

operably connecting the newspaper dispensing apparatus to the gasoline dispensing apparatus;

programming the payment acceptance subsystem of the gasoline dispensing apparatus to accept payment for a newspaper; and signaling the gasoline dispensing apparatus that the adequate payment was received.

18. An automated payment method for allowing a user, in a single transaction through the use of a control device, to purchase gasoline from a gasoline dispensing apparatus and a newspaper from a newspaper dispensing apparatus; said gasoline dispensing apparatus positioned substantially adjacent said newspaper dispensing apparatus and said control device; said control device including a display, a keypad, a microprocessor, a reader, a changer and a dispenser; said method comprising:

(a) said user inputting a transaction payment type at said keypad;

(b) said user inputting a payment into a payment mechanism;

(c) said microprocessor verifying said payment;

(d) said microprocessor prompting said user to input at said keypad whether said user wants to purchase gasoline;

(e) said microprocessor transmitting a control signal to said gasoline dispensing apparatus to dispense gasoline if said user inputs at said keypad that said user wants to purchase gasoline;

(f) said microprocessor prompting said user to input at said keypad whether said user wants to purchase said newspaper; and (g) said microprocessor transmitting a control signal to said newspaper dispensing apparatus to dispense a newspaper if said user inputs at said keypad that said user wants to purchase said newspaper.

* * * * *